US011739555B2

(12) United States Patent
Burnett

(10) Patent No.: US 11,739,555 B2
(45) Date of Patent: Aug. 29, 2023

(54) VEHICLE MOUNTED TENT SYSTEM

(71) Applicant: Michael E. Burnett, Altamonte Springs, FL (US)

(72) Inventor: Michael E. Burnett, Altamonte Springs, FL (US)

( * ) Notice: Subject to any disclaimer, the term of this patent is extended or adjusted under 35 U.S.C. 154(b) by 67 days.

(21) Appl. No.: 17/526,898

(22) Filed: Nov. 15, 2021

(65) Prior Publication Data

US 2022/0162878 A1 May 26, 2022

Related U.S. Application Data

(60) Provisional application No. 63/117,245, filed on Nov. 23, 2020.

(51) Int. Cl.

| | |
|---|---|
| ***E04H 15/06*** | (2006.01) |
| ***E04H 15/48*** | (2006.01) |
| ***E04H 15/32*** | (2006.01) |
| *E04H 15/00* | (2006.01) |

(52) U.S. Cl.

CPC ..... *E04H 15/06* (2013.01); *E04H 15/48* (2013.01); *E04H 15/008* (2013.01); *E04H 15/324* (2013.01)

(58) Field of Classification Search

CPC ..... E04H 15/06; E04H 15/324

See application file for complete search history.

(56) References Cited

U.S. PATENT DOCUMENTS

| | | | | |
|---|---|---|---|---|
| 3,953,066 | A * | 4/1976 | Hamilton | B60P 3/34 135/88.13 |
| 4,176,873 | A * | 12/1979 | Barr | B60P 3/38 296/210 |
| 6,035,875 | A * | 3/2000 | Chen | E04H 15/06 135/88.07 |
| 6,394,531 | B2 * | 5/2002 | Thompson | B60P 3/341 296/26.02 |
| D574,315 | S * | 8/2008 | Swails | D12/401 |
| 9,090,197 | B2 * | 7/2015 | Pierce | B60P 3/341 |
| 10,596,951 | B1 | 3/2020 | Williams | |
| 10,829,028 | B2 * | 11/2020 | Delgadillo, Jr. | B60J 7/1657 |
| 11,059,414 | B2 * | 7/2021 | Dorn | E04H 15/06 |
| 11,371,255 | B2 * | 6/2022 | Frederickson | B60J 7/1621 |
| 2022/0162879 | A1 * | 5/2022 | Davis | E04H 15/008 |

* cited by examiner

*Primary Examiner* — David R Dunn
*Assistant Examiner* — Danielle Jackson
(74) *Attorney, Agent, or Firm* — Jason T. Daniel, Esq.; Daniel Law Offices, P.A.

(57) ABSTRACT

A vehicle mounted tent system includes a vehicle mounting frame for securement to the box of a pickup truck. A clamshell frame assembly having a rigid bed platform and a plurality of U-shaped support rods is connected to the mounting frame. The clamshell frame assembly including a tensioning system and functioning to transition between an open and closed position. A plurality of rigid panels is connected to the vehicle mounting frame and a tent is connected to the clamshell frame assembly. In the open position, the bed platform is positioned forward of the vehicle mounting frame, and the tent is held in an expanded position by each of the plurality of U-shaped support rods. In the closed position, the bed platform is positioned directly above the vehicle mounting frame, and the tent is positioned within a space defined by the plurality of rigid panels.

14 Claims, 11 Drawing Sheets

VEHICLE MOUNTED TENT SYSTEM

CROSS-REFERENCE TO RELATED APPLICATIONS

This application claims the benefit of U.S. Application Ser. No. 63/117,245 filed on Nov. 23, 2020, the contents of which are incorporated herein by reference.

TECHNICAL FIELD

The present invention relates generally to tent and camping systems, and more particularly to a tent for fastening to a motor vehicle.

BACKGROUND

The statements in this section merely provide background information related to the present disclosure and may not constitute prior art.

Many outdoors enthusiasts enjoy camping but setting up a tent can be time consuming and inconvenient, especially when there are no suitable places to put a tent. Additionally, it is beneficial for the tent to be positioned on a raised platform whenever possible, so as to avoid crawling bugs, standing ground water and/or curious wildlife. For this reason, there are several known types of vehicle tent systems that are designed to attach to the roof and/or truck bed of a motor vehicle.

Although useful in certain situations, these systems have several drawbacks. For example, typical vehicle tent systems require specialized mounting hardware that can damage the roof of the vehicle itself. Moreover, tent systems specifically designed for use with pickup trucks typically include bulky frame and support structures that are complicated to assemble and that are difficult to operate when transitioning the same between the stowed and unstowed positions. Finally, even in the collapsed and stowed position, such systems typically remain attached to the roof of the vehicle, thereby causing substantial wind resistance that affects the efficiency of the vehicle while presenting an aesthetically unpleasing appearance.

Accordingly, it would be beneficial to provide a vehicle mounted tent system that does not suffer from the drawbacks described above.

SUMMARY OF THE INVENTION

The present invention is directed to a vehicle mounted tent system. One embodiment of the present invention can include a vehicle mounting frame having a plurality of horizontally oriented mounting rails for securement to the box of a pickup truck. A clamshell frame assembly can be secured onto a top portion of the vehicle mounting frame.

In one embodiment, the clamshell frame assembly can include a rigid bed platform and a plurality of U-shaped support rods that rotate between a closed position and an open position. The clamshell frame assembly can further include a tensioning system having a plurality of cables that are in communication with each of the U-shaped support rods and the rigid bed platform.

In one embodiment, the system can include an enclosure having a plurality of rigid panels that are connected to the vehicle mounting frame and a tent that is connected to the clamshell frame assembly. In the open position, the bed platform can be positioned forward of the vehicle mounting frame, and the tent is held in an expanded position by each of the plurality of U-shaped support rods. In the closed position, the bed platform is positioned directly above the vehicle mounting frame, and the tent is positioned within a space defined by the plurality of rigid panels.

This summary is provided merely to introduce certain concepts and not to identify key or essential features of the claimed subject matter.

BRIEF DESCRIPTION OF THE DRAWINGS

Presently preferred embodiments are shown in the drawings. It should be appreciated, however, that the invention is not limited to the precise arrangements and instrumentalities shown.

DETAILED DESCRIPTION OF THE INVENTION

Figure 1:
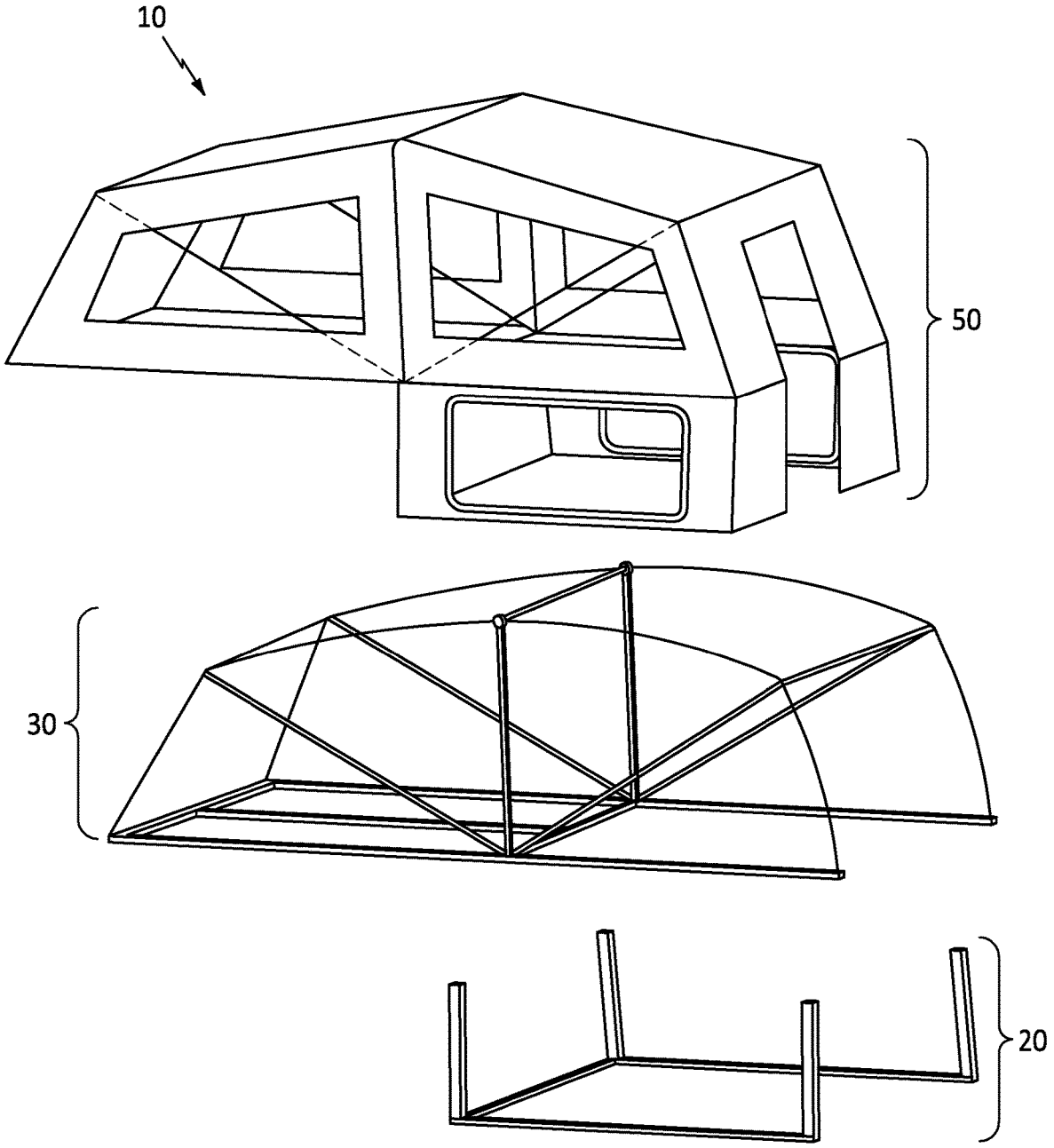
FIG. 1 is an exploded parts view of a vehicle mounted tent system that is useful for understanding the inventive concepts disclosed herein.
Figure 2:
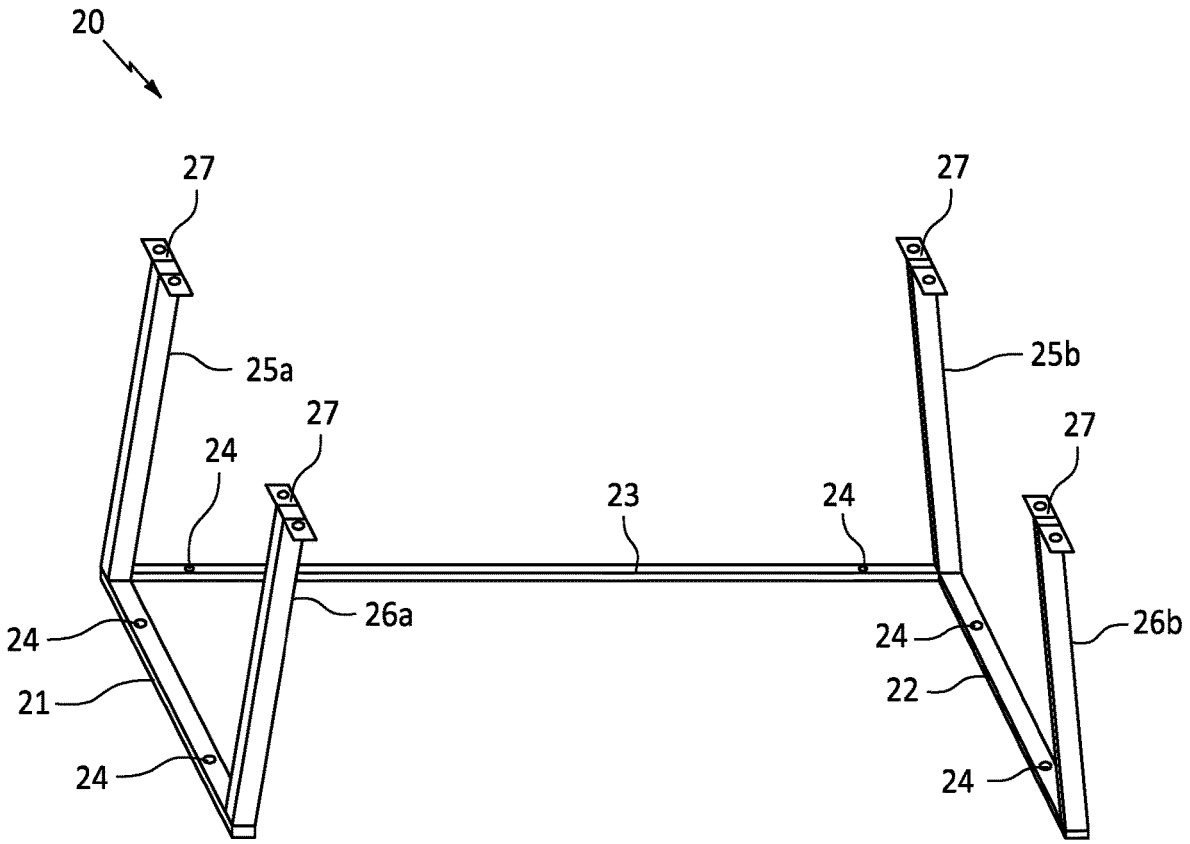
FIG. 2 is a perspective view of the vehicle mounting frame of the vehicle mounted tent system in accordance with one embodiment of the invention.

While the specification concludes with claims defining the features of the invention that are regarded as novel, it is believed that the invention will be better understood from a consideration of the description in conjunction with the drawings. As required, detailed embodiments of the present invention are disclosed herein; however, it is to be understood that the disclosed embodiments are merely exemplary of the invention which can be embodied in various forms.

Therefore, specific structural and functional details disclosed herein are not to be interpreted as limiting, but merely as a basis for the claims and as a representative basis for teaching one skilled in the art to variously employ the inventive arrangements in virtually any appropriately detailed structure. Further, the terms and phrases used herein are not intended to be limiting but rather to provide an understandable description of the invention.

Definitions

As described herein, a "unit" means a series of identified physical components which are linked together and/or function together to perform a specified function.

As described throughout this document, the term "about" "approximately" "substantially" and "generally" shall be used interchangeably to describe a feature, shape, or measurement of a component within a tolerance such as, for example, manufacturing tolerances, measurement tolerances or the like.

As described herein, the term "removably secured," and derivatives thereof shall be used to describe a situation wherein two or more objects are joined together in a non-permanent manner so as to allow the same objects to be repeatedly joined and separated.

As described herein, the term "hingedly connected" "rotatably secured" and derivatives thereof shall be used interchangeably to describe a situation wherein two or more identified objects are joined together in a manner that allows one or both of the objects to pivot, rotate, and/or move about or in relation to the other object in one or more of a horizontal, diagonal or vertical manner. Several nonlimiting examples of connectors for pivotally connecting objects together include traditional single or double hinge mechanisms, ball joint couplers, single axis pins, and/or swivel flanges, for example.

As described throughout this document, the term "complementary shape," and "complementary dimension," shall be used to describe a shape and a size of an identified component that is identical to, or substantially identical to the shape and/or size of another identified component within a tolerance such as, for example, manufacturing tolerances, measurement tolerances or the like.

As described herein, the term "connector" includes any number of different elements that work alone or together to repeatedly join two items together in a nonpermanent manner. Several nonlimiting examples include opposing strips of hook and loop material (i.e. Velcro®), attractively-oriented magnetic elements, flexible strips of interlocking projections with a slider (i.e., zipper), a thin, flexible strap with a notched surface and one end threaded through a locking mechanism (i.e., zip tie) at the other, tethers, buckles such as side release buckles, and compression fittings such as T-handle rubber draw latches, hooks, snaps and buttons, for example. Each illustrated connector and complementary connector can be permanently secured to the illustrated portion of the device via a permanent sealer such as glue, adhesive tape, or stitching, for example.

FIGS. 1-8B illustrate one embodiment of a vehicle mounted tent system 10 that are useful for understanding the inventive concepts disclosed herein. In each of the drawings, identical reference numerals are used for like elements of the invention or elements of like function. For the sake of clarity, only those reference numerals are shown in the individual figures which are necessary for the description of the respective figure. For purposes of this description, the terms "upper," "bottom," "right," "left," "front," "vertical," "horizontal," and derivatives thereof shall relate to the invention as oriented in FIG. 7B.

As shown in the exploded parts view of FIG. 1, one embodiment of the tent system 10 can include, essentially, a vehicle mounting frame 20, a clamshell frame assembly 30 and an outer body 50. As will be described below, the frame 20 can be secured onto the box of a pickup truck, and the frame assembly 30 and outer body 50 can transition between a closed position for transport and storage (see FIG. 6), and an open position that defines an enclosed living space for use when camping (see FIG. 7A).

The vehicle mounting frame 20 can function to secure the system 10 onto a motor vehicle. As shown best at FIG. 2, the preferred embodiment of the vehicle mounting frame 20 can include three horizontal mounting rails 21, 22 and 23 that are arranged in a generally U-shaped manner so as to be positioned atop and secured to the sides and cross rail of the box of a pickup truck, respectively. To this end, each of the rails can include any number of apertures 24 to receive mounting hardware such as clamps, nuts and bolts or other such connectors to secure the respective rail onto the vehicle.

In the illustrated embodiment, a pair of forward connection arms 25*a*-25*b* can extend vertically upward from the front ends of rails 21 and 22, respectively, and a pair of rear connection arms 26*a*-26*b* can extend vertically upward from the back ends of rails 21 and 22, respectively. In one embodiment, mounting brackets 27 can be positioned along the upper ends of each of the connection arms in order to engage and secure the clamshell frame assembly thereto. As shown, each of the connection arms 25*a*/25*b* and 26*a*/26*b* can be oriented vertically at any number of different angles. Ideally, the angles will correspond to the pitch of the truck cab for which the system is designed to be mated with. In various embodiments, such a design can advantageously ensure the installed system does not include a width that is greater than the width of the vehicle itself.

In the preferred embodiment, the vehicle mounting frame 20 can be constructed from a sturdy metal such as steel or aluminum, for example, and each element can be welded together to form a unitary member. Of course, other embodiments, are contemplated wherein the frame components are constructed from different metal or non-metal materials and/or wherein the frame components are joined together in a different manner. Likewise, other embodiments are contemplated wherein the connection arms are positioned at other angles.

Figure 3A:
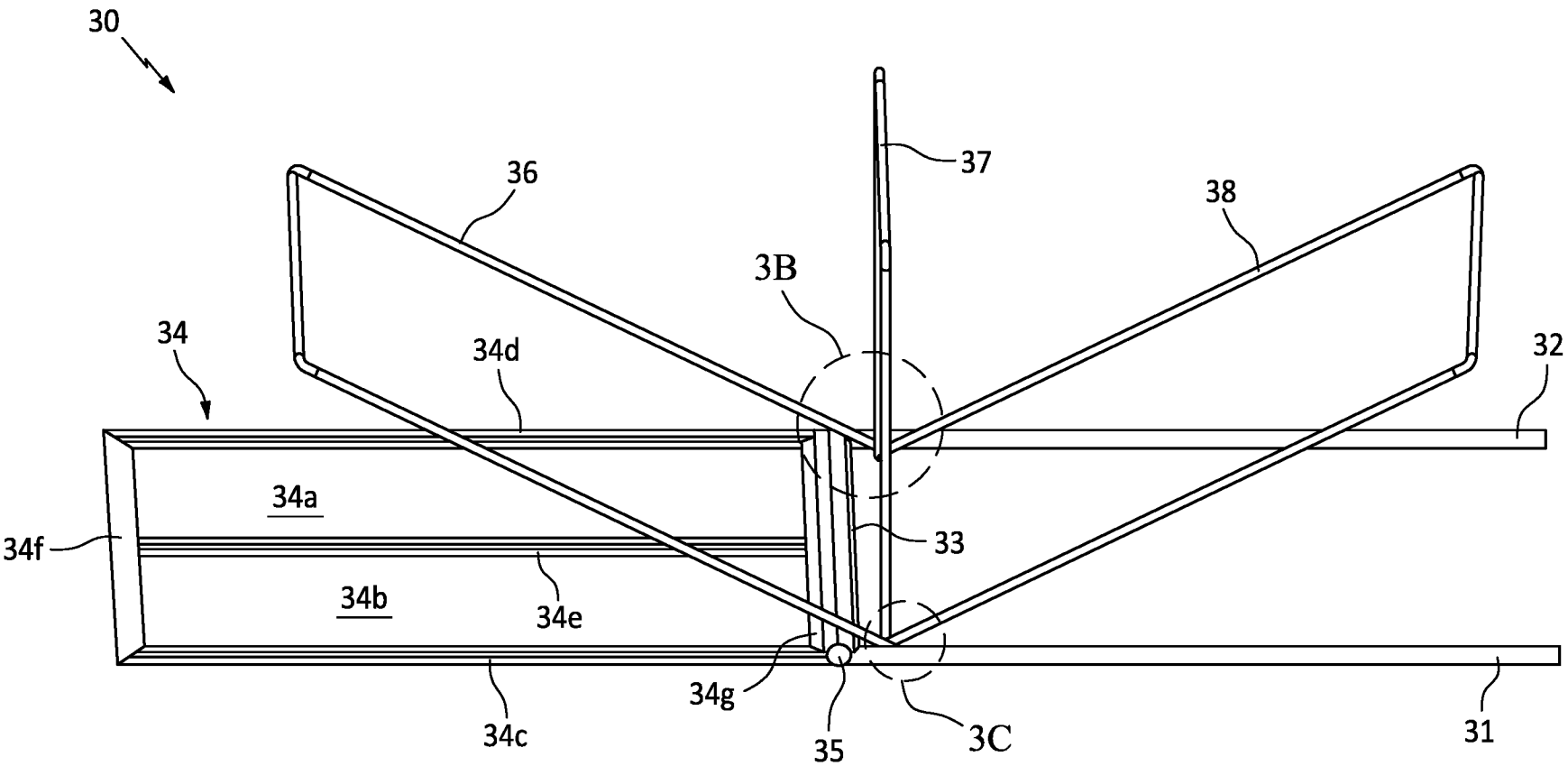
FIG. 3A is a side view of the clamshell frame assembly of the vehicle mounted tent system in accordance with one embodiment of the invention.
Figure 3B:
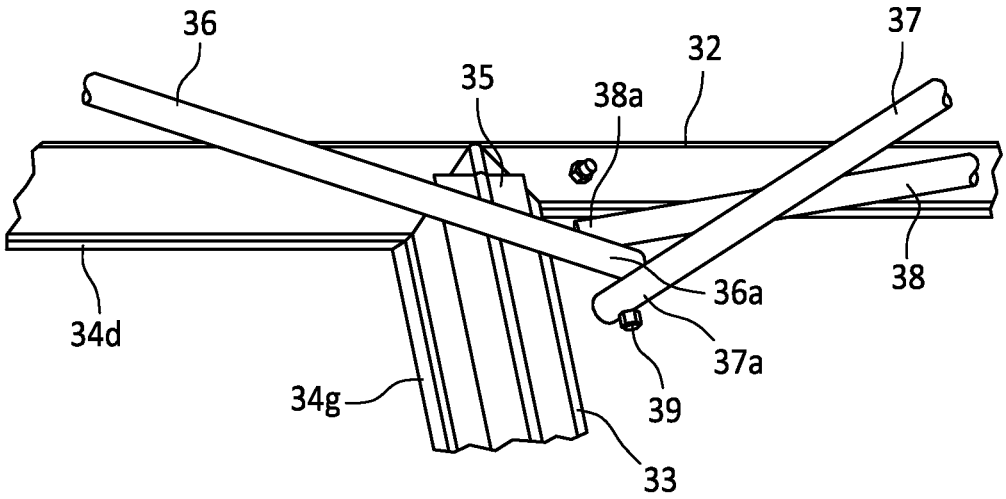
FIG. 3B is a partial cutout view of the clamshell frame assembly of the vehicle mounted tent system in accordance with one embodiment of the invention.
Figure 3C:
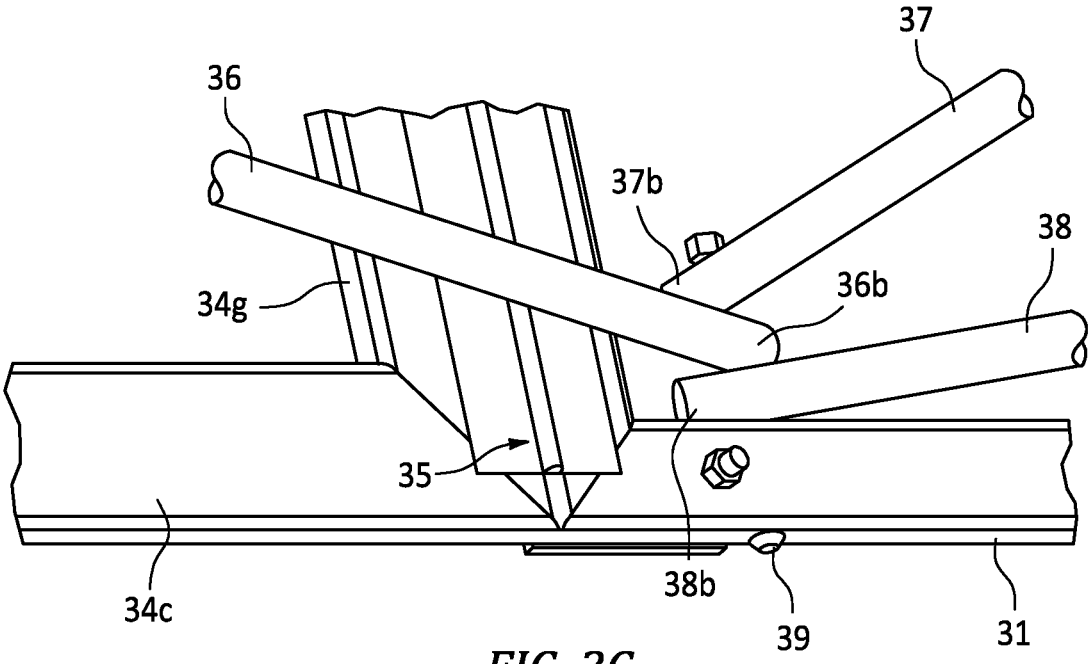
FIG. 3C is another partial cutout view of the clamshell frame assembly of the vehicle mounted tent system in accordance with one embodiment of the invention.

FIGS. 3A-3C illustrate one embodiment of the clamshell frame assembly 30 which can be secured onto the vertical connection arms of the vehicle mounting frame 20 described above. As shown, the clamshell assembly can include horizontal rails 31, 32 and 33 that can be arranged in a generally U-shaped manner. In one embodiment, rails 31-33 can include a complementary shape, size, and orientation as mounting rails 21-23 described above; however other embodiments are contemplated wherein rails 31-33 include a smaller dimension so as to be narrower than rails 21-23 (e.g., distance between rails 31 and 32 is less than distance between rails 21 and 22). In either instance, rails 31-33 will preferably be constructed from the same material as rails 21-23 described above, however other shapes and construction materials are also contemplated.

In one embodiment, a rigid bed platform 34 can be rotatably connected to the mounting rail 33 via an elongated hinge 35. In the illustrated embodiment, the rigid bed platform can include two elongated flat planks 34*a* and 34*b* that are connected by sub-frame members 34*c*, 34*d*, 34*e* 34*f* and 34*g* to form the illustrated rectangular shape. In the preferred embodiment, the planks 34*a* and 34*b* will be constructed from a rugged lightweight (e.g., less than 5 pounds) composite material such as honeycomb cell platforms, for example, in order to allow a user to easily transition the system between the open and closed positions.

Although described above as including different materials and sub-frame members to create the rigid bed platform, this is for illustrative purposes only. To this end, other embodiments are contemplated wherein the rigid bed platform is constructed from other materials such as wood or plastic, for example, which may or may not include the illustrated sub-frame members and/or may be constructed to include a different shape or size platform.

In one embodiment, the clamshell frame 30 can include three articulating and generally U-shaped support rods 36, 37 and 38. As shown best at cutout FIG. 3B, the distal ends 36*a*-36*b*, 37*a*-37*b* and 38*a*-38*b* of each of the support rod that can be rotatably connected to the inside walls of rails 31 and 32 via elongated bolts 39. In this regard, each of the support rods can transition between the open position shown at FIG. 3A and the closed position shown at FIG. 4B. Moreover, when in the closed position, each of the support rods 36-38 will be located beneath the bed platform 34 which will rest completely flat atop the rails 31 and 32.

Although described above with regard to three support rods having a particular shape and connection hardware, this is for illustrative purposes, as other embodiments are contemplated. To this end, each of the support rods can include any number of other shapes and can also be hingedly secured onto the rails 31, 32 and/or 33 via any number of other type of hardware that permits movement of the support rods in the manner described herein.

Figure 4A:
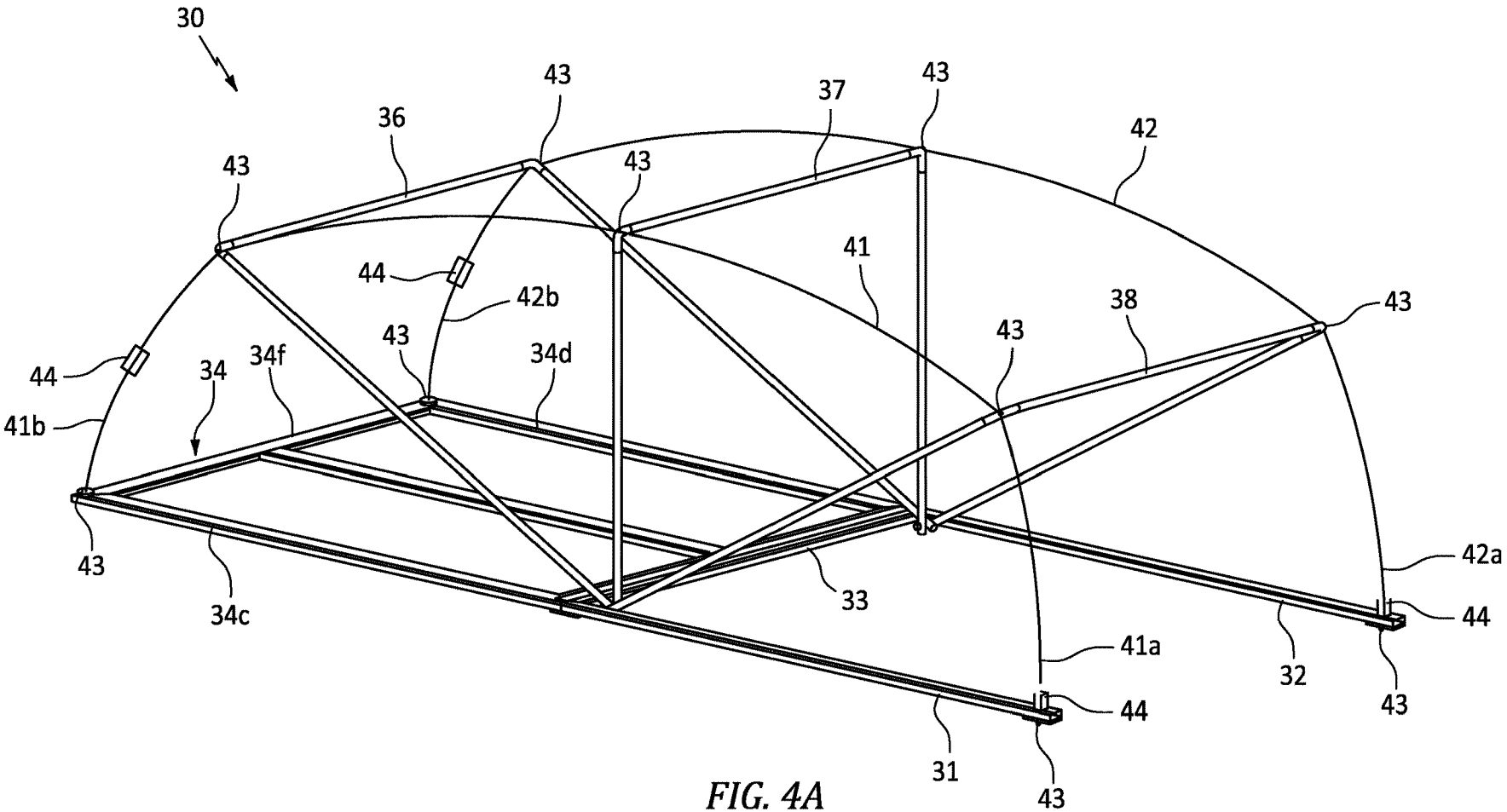
FIG. 4A is a perspective view of the clamshell frame assembly of the vehicle mounted tent system in the open position, in accordance with one embodiment of the invention.

As shown at FIG. 4A, one embodiment of the frame assembly 30 includes a pair of elongated cables 41 and 42 that are connected at their first ends 41*a* and 42*a* to the ends of rails 31 and 32, respectively, and that are connected at their second ends 41*b* and 42*b* to the ends of the sub-frame members 34*c* and 34*d*, respectively. Additionally, each of the cables are connected to the U-shaped support rods 36, 37 and 38.

As described herein, each of the cables 41 and 42 can be constructed from any number of different materials having excellent durability and tensile strength. Several nonlimiting examples include, but are not limited to steel cable, galvanized wire rope, twisted polypropylene rope, and/or braded nylon rope, among others, for example. Likewise, cables 41 and 42 can preferably be connected at 43 to the illustrated components using eye bolts; however, any number of other types of connectors and/or known rigging components are also contemplated. In various embodiments, the eye bolts can be connected to the rails 31 and 32 and can function as a tensioning mechanism for the cables. Although described above with regard to two continuous cables, other embodiments are contemplated wherein a plurality of different cables are used between the illustrated components.

In operation, the cables can function to properly space and maintain the support rods 36-38 and bed platform 34 in the open position shown at FIG. 4A. More specifically, the tethers function to support the weight of the bed platform 34 which is positioned above, but is not in contact with, the cab 3 of the vehicle 1 when the system is in the open position. Such a feature advantageously eliminates the need for any type of external bracing or other such support devices that would otherwise make contact with the vehicle itself.

In one embodiment, any number of tensioning devices 44 such as the above described eye bolts and/or turnbuckle wire tensioners, for example, can be provided along each of the cables in order to allow a user to adjust the length of the cables. Such a feature advantageously allowing a user to adjust the pitch (e.g., up and down) and/or levelness (e.g., side to side) of the bed platform and other components during operation. Although illustrated with four tensioning devices, other embodiments are contemplated wherein a different number of tensioning devices are provided, including the ability to position such devices between the support rods 36-38 to permit manual adjustment of the location of these components as well.

Figure 4B:
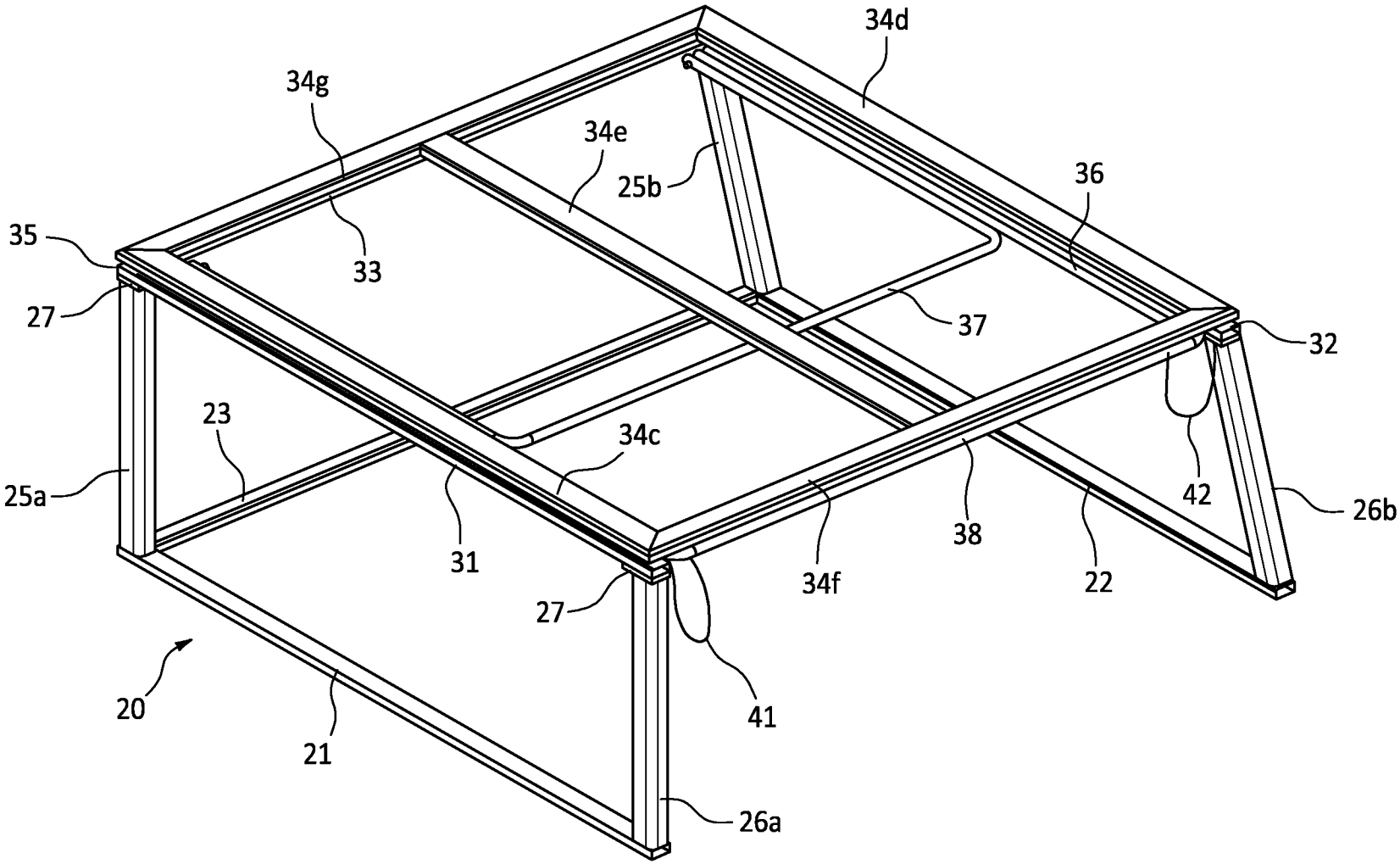
FIG. 4B is a perspective view of the clamshell frame assembly of the vehicle mounted tent system in the closed position, in accordance with one embodiment of the invention.

FIG. 4B illustrates one embodiment of the system 10 is in the closed position. As shown, in this position the support rods 36-38 are aligned parallel with the rails 31-32, and the rigid platform 34 is positioned atop the walls 51-53 so as to be located directly above the vehicle mounting frame 20 to as to occupy a minimum amount of space.

Figure 5:
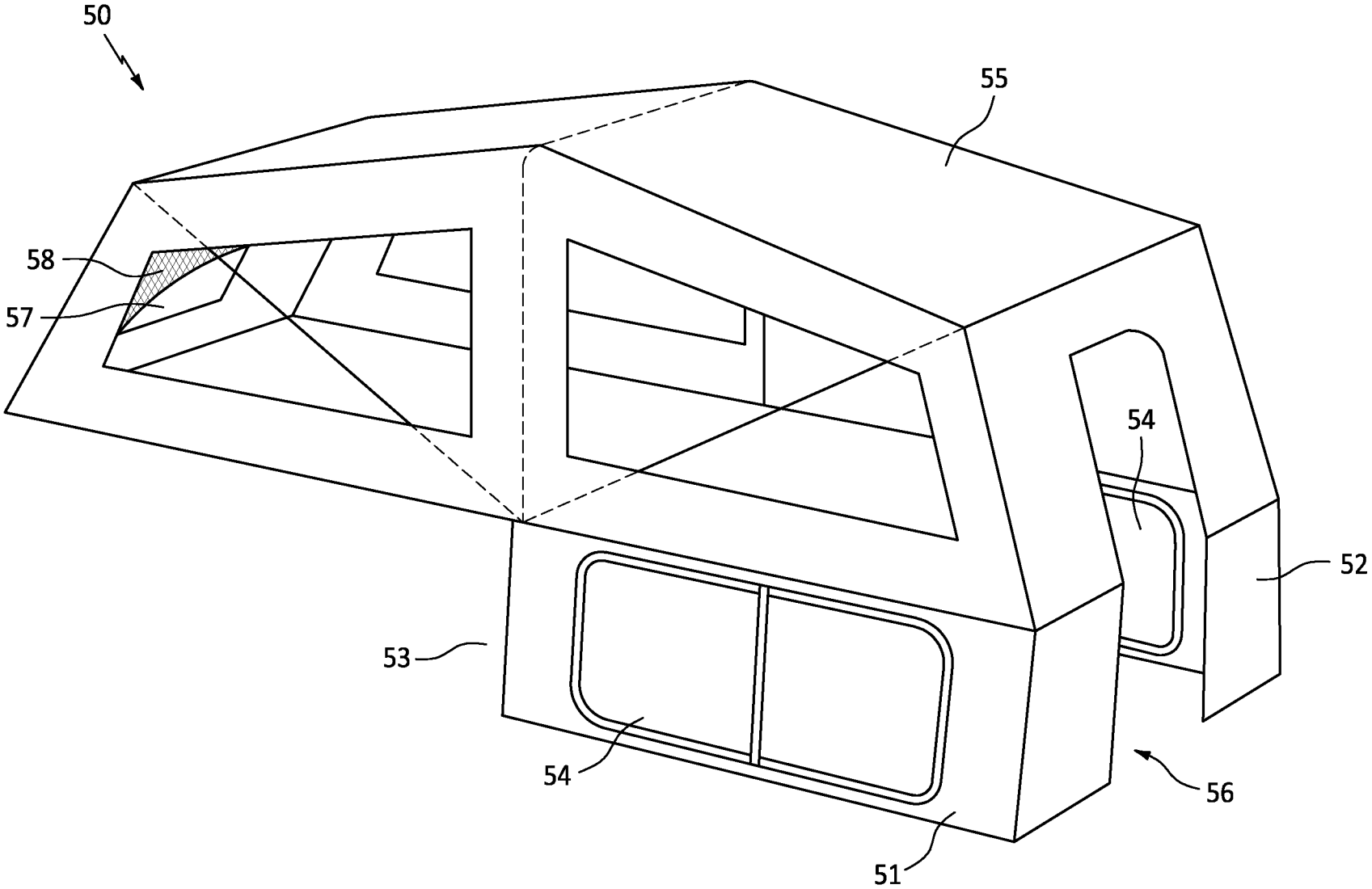
FIG. 5 is a perspective view of the enclosure of the vehicle mounted tent system in accordance with one embodiment of the invention.

FIG. 5 illustrates one embodiment of the outer body which can be secured to the above-described vehicle mounting frame 20, and clamshell frame assembly 30 to form an enclosed space into which a user can reside. In one embodiment, the outer body can include a base portion that is defined by a first sidewall 51, a second sidewall 52 and a front wall 53 which create an interior volume when set onto the box of the truck. To this end, walls 51, 52 and 53 can be in communication with each of the horizontal mounting rails 21, 22 and 23, respectively, and the connection arms 25*a*/25*b* and 26*a*/26*b*.

As described herein, the walls 51-53 will preferably be formed from materials that are, for example, relatively strong and stiff for their weight. Several nonlimiting examples include but are not limited to various metals or metal alloys (e.g., aluminum, steel, titanium, or alloys thereof), plastic/polymers (e.g., high-density polyethylene (HDPE), rigid polyvinyl chloride (PVC), or polyethylene terephthalate (PET)), and/or various composite materials (e.g., carbon fibers in a polymer matrix, fiberglass, etc.) or natural materials such as wood, for example.

In one embodiment, windows 54 can be positioned along the walls 51 and 52. Windows can be constructed from any suitable transparent or translucent material and may include functionality for transitioning between an open and closed position along with window screens as are known in the art.

In one embodiment, the enclosure can also include a tent 55 that is preferably constructed from a malleable and impermeable material such as synthetic fabric, for example, that is designed to prevent water and/or debris from passing therethrough. In one embodiment, the bottom end of the tent can be connected to the top surfaces of each of the walls 51-53, and the inside surface of the tent can be connected to each of the rails 31-32, the bed platform 34 and the U-shaped support rods 36-38 of the clamshell assembly 30.

In one embodiment, the tent can include a large door portion 56 along the back end to permit ingress and egress of an occupant. To this end, the door may include a flap of material having a zipper or other type of connector for securing the door in either the open or closed position. In various embodiments, the tent can include any number of windows 57 which may also include a mesh surface 58 for permitting air to pass through the system when open.

Figure 6:
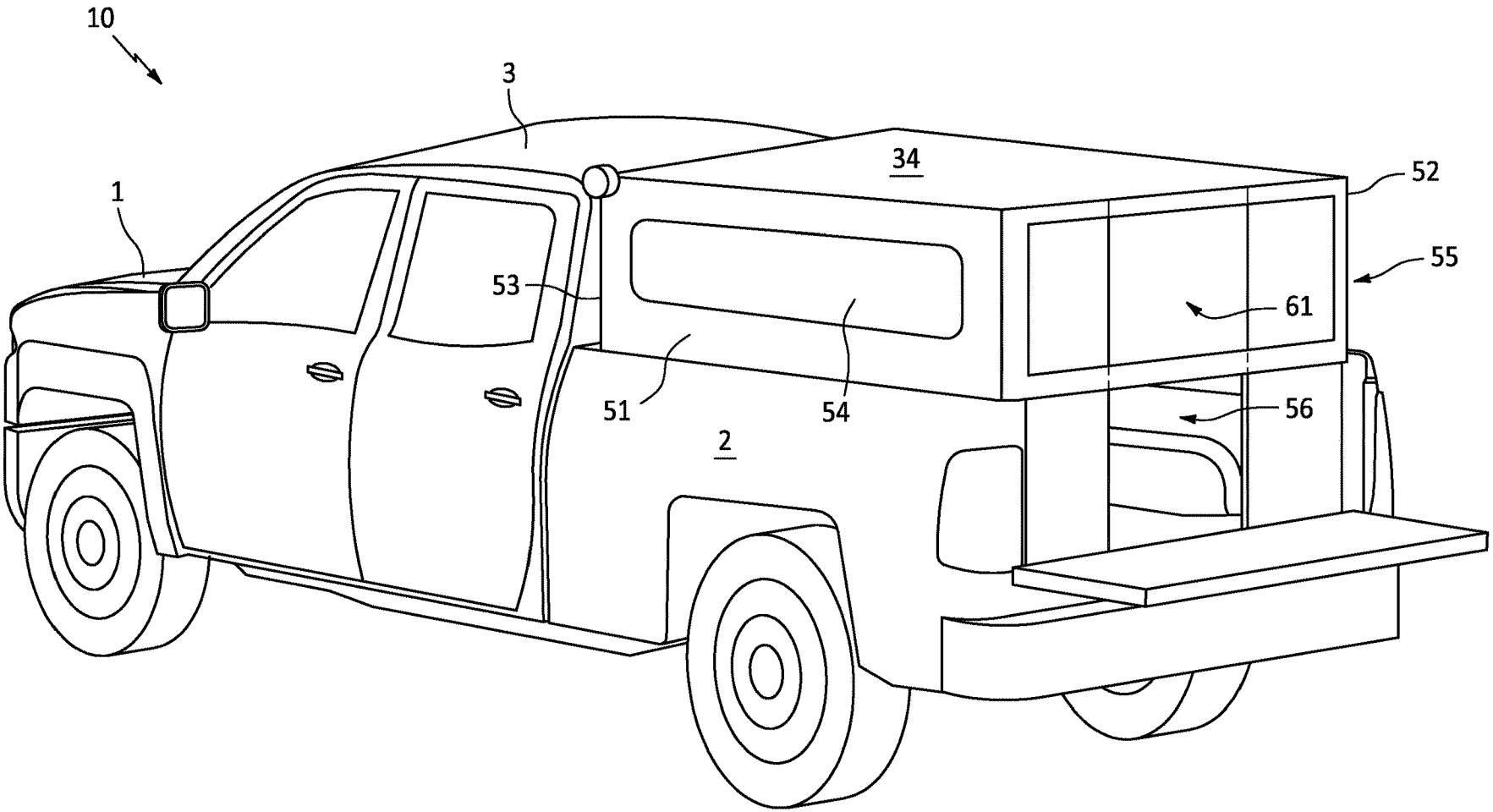
FIG. 6 is a perspective view of the vehicle mounted tent system in the closed position in operation, in accordance with one embodiment of the invention.

FIG. 6 illustrates one embodiment of the system 10 in the closed position on a truck 1 having a bed 2 and a cab 3. As shown, in the closed position the tent 55 is secured within the space created by the walls 51-53, and the rigid platform 34 that is resting atop each of the walls 51-53. In one embodiment, the system can further include a rigid rear-facing window 61 which can be removably connected along the back end of the frame assembly and/or tent when the system is in the closed position. As shown, the window 61 can extend downward to be even with the side rails of the vehicle to which the system is attached. Prior to opening the tent, the window can be removed to permit operation of the system in the manner described.

Notably, because the system in the closed position provides a completely rigid exterior along the sides (e.g., 51 and 52) the top (e.g., 34) and the front and back ends (e.g., 53 and 61), the system advantageously allows a user to store or attach any number of external items onto the outside facing surface of the platform 34.

Figure 7A:
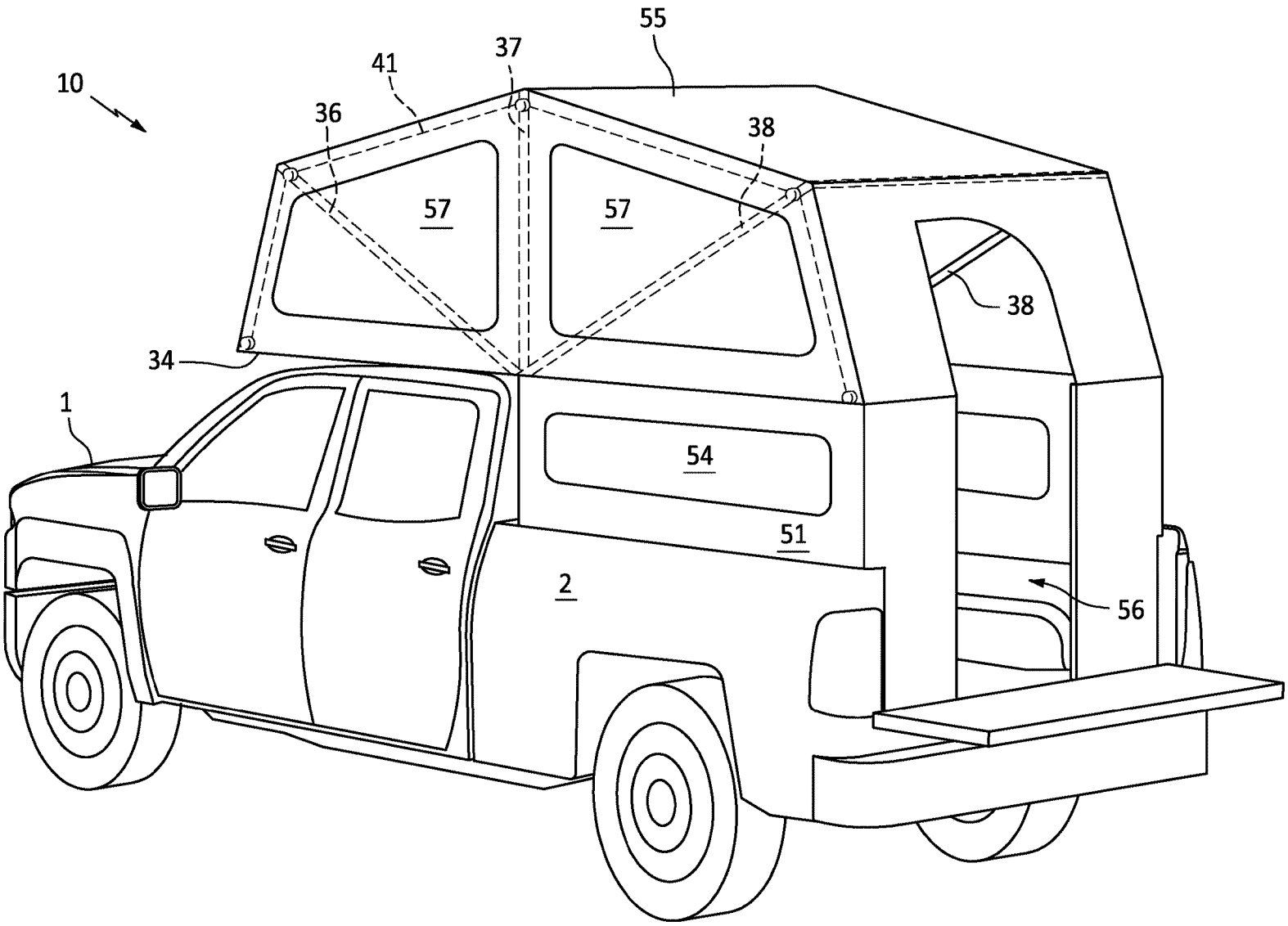
FIG. 7A is a perspective view of the vehicle mounted tent system in the open position in operation, in accordance with one embodiment of the invention.
Figure 7B:
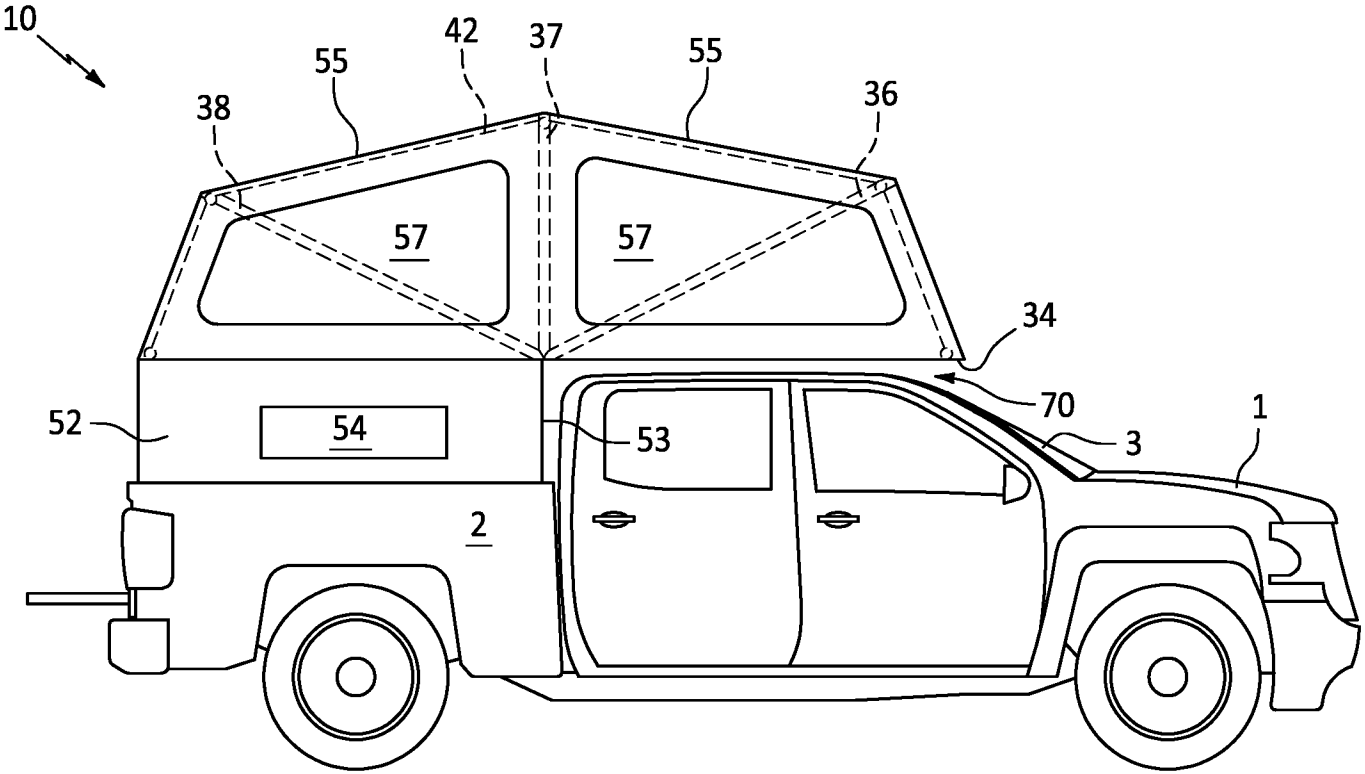
FIG. 7B is another perspective view of the vehicle mounted tent system in the open position in operation, in accordance with one embodiment of the invention.

As shown at FIGS. 7A and 7B, the system can transition to the open position whereby the bed platform 34 is rotated toward the cab 3 of the vehicle. Through this movement, each of the U-shaped support rods 36, 37 and 38 will deploy thus causing the tent 55 to fully extend. When extended, the tent 55 and walls 51-53 define a large interior space for a user to occupy. Moreover, as noted above, the cables 41 and 42 provide tension to the system that prevents the bed platform 34 from making contact with the cab 3 as shown at 70 even though the bed platform is positioned above and forward of the vehicle mounting frame 20. Such a feature eliminates the need for any type of external bracing or attachment mechanisms over or forward of the cab 3.

Figure 8A:
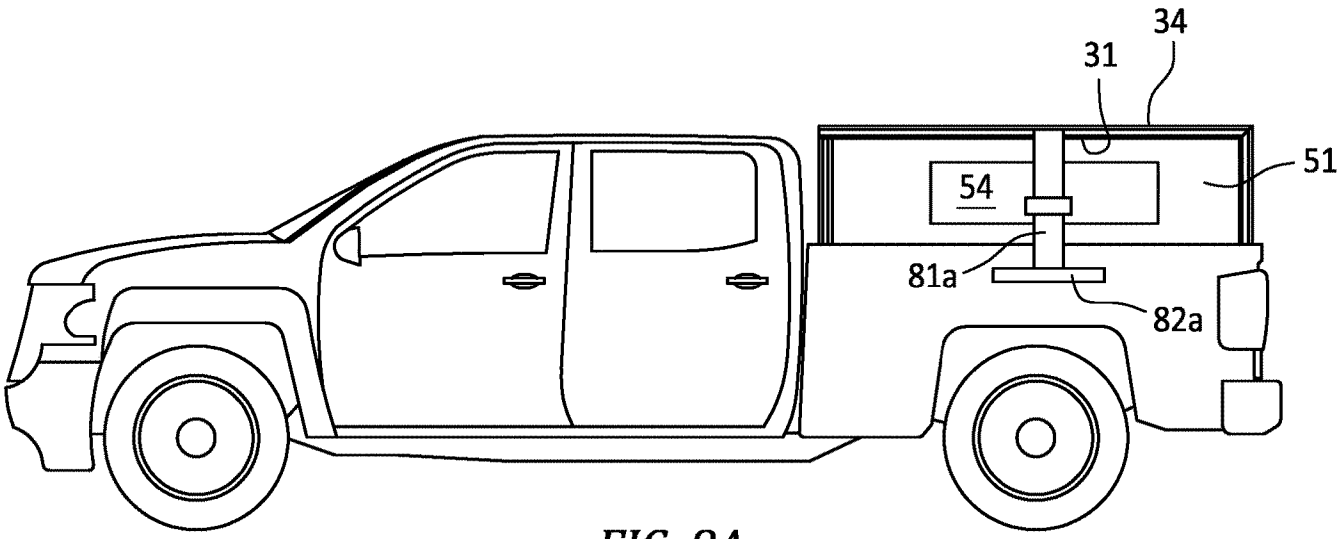
FIG. 8A is a side view of the vehicle mounted tent system in operation, in accordance with one embodiment of the invention.
Figure 8B:
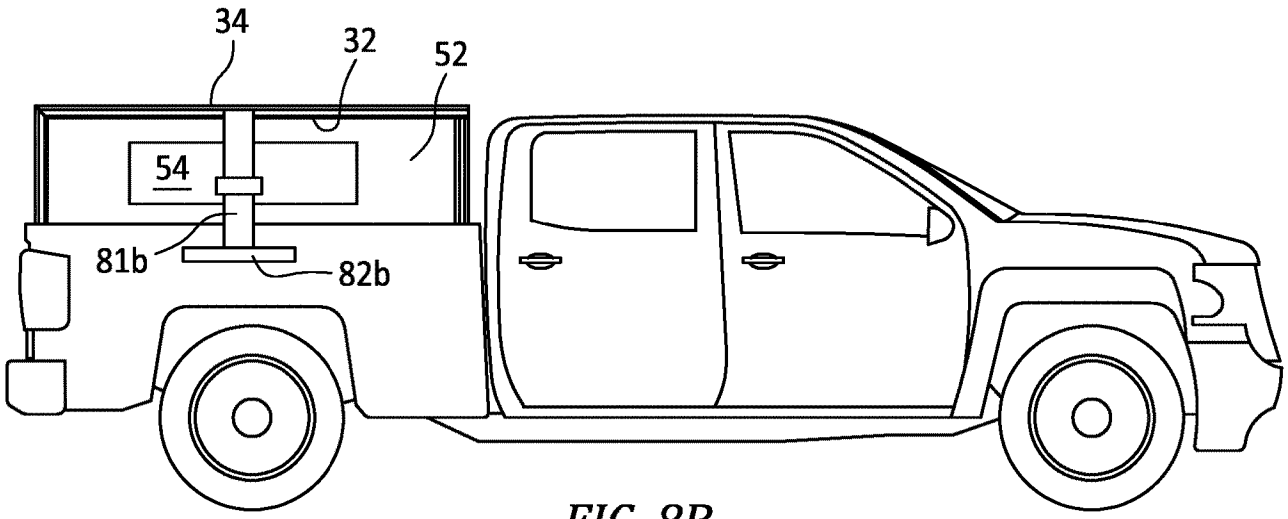
FIG. 8B is another side view of the vehicle mounted tent system in operation, in accordance with one embodiment of the invention.

As shown at FIGS. 8A and 8B, one embodiment, the system 10 can further include a lifting handle assembly that includes a pair of telescoping rods 81*a* and 81*b* that extend downward from the middle of the horizontal rails 31 and 32, respectively. Each of the rods including a handle 82*a* and 82*b* along their distal ends for permitting two users to grasp and lift the sides of the system 10 when installing and uninstalling the same from the vehicle. In the preferred embodiment, each of the rods can be removably attached to the rails, however other embodiments are contemplated wherein the rods are permanently attached.

Although not specifically illustrated, other embodiments are contemplated wherein a plurality of resilient and/or elastomeric tethers are provided along the interior or exterior of the enclosure so as to extend from one side of the system to the other. More specifically, each of the tethers can extend along the tent to apply a compressive force onto the same. Such a feature being beneficial when transitioning the system from the open position to the closed position, as the compressive force aids in folding the fabric tent downward rather than allowing the same to crumple.

As described herein, one or more elements of the vehicle mounted tent system 10 can be secured together utilizing any number of known attachment means such as, for example, screws, glue, compression fittings and welds, among others. Moreover, although the above embodiments have been described as including separate individual elements, the inventive concepts disclosed herein are not so limiting. To this end, one of skill in the art will recognize that one or more individually identified elements may be formed together as one or more continuous elements, either through manufacturing processes, such as welding, casting, or molding, or through the use of a singular piece of material milled or machined with the aforementioned components forming identifiable sections thereof.

As to a further description of the manner and use of the present invention, the same should be apparent from the above description. Accordingly, no further discussion relating to the manner of usage and operation will be provided.

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. Likewise, the term "consisting" shall be used to describe only those components identified. In each instance where a device comprises certain elements, it will inherently consist of each of those identified elements as well.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

The invention claimed is:

1. A vehicle mounted tent system, comprising:

a vehicle mounting frame that is configured to be secured onto a box of a truck, said vehicle mounting frame including three horizontal mounting rails that are arranged in a U-shaped manner;

a plurality of connection arms that extend vertically upward from the horizontal mounting rails;

a clamshell frame assembly that is secured onto a top portion of the vehicle mounting frame;

a plurality of rigid panels each having a top end and a bottom end, each of the plurality of rigid panels being in communication with the vehicle mounting frame; and a tent having a bottom end that is connected to the top end of each of the plurality of rigid panels, wherein the clamshell frame assembly is in communication with an inside surface of the tent, and each of the clamshell frame and tent are configured to transition between a closed position and an open position.

2. The system of claim 1, wherein the clamshell frame assembly is positioned above the horizontal mounting rails by the plurality of connection arms.

3. The system of claim 1, wherein the clamshell frame assembly includes a pair of parallel rails and a transverse rail that form a U-shaped member.

4. The system of claim 3, wherein the clamshell frame assembly includes a bed platform that is rotatably connected onto the transverse rail.

5. The system of claim 4, wherein the clamshell frame assembly includes a plurality of U-shaped support rods.

6. The system of claim 5, wherein each of the plurality of U-shaped support rods are configured to move independently of each other.

7. The system of claim 5, wherein each of the plurality of U-shaped support rods are rotatably secured onto each of the pair of parallel rails.

8. The system of claim 7, further comprising:

a tensioning system that is in communication with each of the plurality of U-shaped support rods, the bed platform and one of the pair of parallel rails.

9. The system of claim 5, wherein each of the plurality of U-shaped support rods, and the bed platform are in communication with the inside surface of the tent.

10. The system of claim 9, wherein in the open position, the bed platform is positioned forward of the pair parallel rails and the transverse rail, and the tent is held in an expanded position by each of the plurality of U-shaped support rods.

11. The system of claim 9, wherein in the closed position, the bed platform is positioned on top of the pair of parallel rails and the transverse rail, and the tent is positioned within a space defined by the plurality of rigid panels.

12. The system of claim 1, further comprising:

a door that is positioned along the tent.

13. The system of claim 1, further comprising:

at least one window that is positioned along the tent.

14. The system of claim 1, further comprising:

at least one window that is positioned along one of the plurality of rigid panels.

* * * * *